US006598273B2

(12) United States Patent
Buettell

(10) Patent No.: US 6,598,273 B2
(45) Date of Patent: Jul. 29, 2003

(54) LANYARD BUCKLE CONNECTOR

(75) Inventor: Bruce J. Buettell, Fullerton, CA (US)

(73) Assignee: J.A.M. Plastics, Inc., Anaheim, CA (US)

( * ) Notice: Subject to any disclaimer, the term of this patent is extended or adjusted under 35 U.S.C. 154(b) by 0 days.

(21) Appl. No.: 09/951,841

(22) Filed: Sep. 10, 2001

(65) Prior Publication Data

US 2003/0046797 A1 Mar. 13, 2003

(51) Int. Cl.[7] ..... A44B 21/00; A44C 3/00

(52) U.S. Cl. ..... 24/316; 24/3.12; 24/3.13; 24/265 AL; 24/318; 224/197; 224/271

(58) Field of Search ..... 24/3.12, 265 AL, 24/458, 3.13, 316, 318; 224/197, 198, 269, 271; 361/814; 455/90, 351

(56) References Cited

U.S. PATENT DOCUMENTS

| | | | | | |
|---|---|---|---|---|---|
| 1,215,283 | A | * | 2/1917 | Kirkland | 24/3.12 |
| D178,869 | S | | 10/1956 | Cousins | |
| 3,161,252 | A | | 12/1964 | Brown | |
| D255,066 | S | | 5/1980 | Hadgis | |
| 4,277,863 | A | * | 7/1981 | Faneuf | 24/3.12 |
| 4,306,434 | A | * | 12/1981 | Drake | 70/458 |
| D272,231 | S | | 1/1984 | Black, Jr. | |
| 4,667,782 | A | | 5/1987 | Toase et al. | |
| D298,738 | S | | 11/1988 | Rumpel | |
| 4,802,262 | A | | 2/1989 | Kasai | |
| 5,432,985 | A | * | 7/1995 | Bernart | 24/265 AL |
| 5,564,166 | A | * | 10/1996 | Roy | 24/3.13 |
| D379,299 | S | | 5/1997 | Fitzgibbons | |
| 5,640,742 | A | * | 6/1997 | White et al. | 24/3.12 |
| 5,651,573 | A | | 7/1997 | Germain | |
| 5,864,925 | A | * | 2/1999 | McGee | 24/3.13 |
| 5,983,760 | A | * | 11/1999 | Clarke | 24/298 |
| 6,108,957 | A | * | 8/2000 | Zapawa | 40/654.01 |
| D442,068 | S | | 5/2001 | Buettell | |
| 6,290,112 | B1 | * | 9/2001 | Iver | 224/271 |
| 6,301,751 | B1 | * | 10/2001 | Ohlson | 24/3.12 |
| 6,305,053 | B1 | | 10/2001 | Galbreath | |

FOREIGN PATENT DOCUMENTS

| | | | | |
|---|---|---|---|---|
| JP | 11-187910 | * | 11/1999 | 24/3.12 |

* cited by examiner

*Primary Examiner*—Victor Sakran
(74) *Attorney, Agent, or Firm*—Knobbe, Martens, Olson & Bear, LLP

(57) ABSTRACT

An identification badge is connected to a lanyard using at least two connectors. One of the connectors securely connects a fixture which clasps the identification badge to a buckle. The other connector securely connects the buckle to the lanyard. The connectors are configured to position the badge flat on the shirt or blouse of the wearer so that the visibility of the badge is maximized. The size of the connectors is maintained small. Furthermore, assembly of a lanyard, badge, and buckle combination is made more efficient by making the connectors quick-connect.

11 Claims, 5 Drawing Sheets

LANYARD BUCKLE CONNECTOR

BACKGROUND OF THE INVENTION

1. Field of the Invention

This invention relates to a lanyard buckle connector for attaching a lanyard to a buckle and for attaching the buckle to a fitting.

2. Description of the Related Art

People wear visual identification devices in social, industrial, and professional setting. One such wearable identification device common in social settings is the paper name tag. The paper name tag is configured with an adhesive to affix the tag to a user's shirt and a surface for printing the user's name. Other types of name tags are known, for example, identification badges, which are more durable than the paper name tag.

The need for industrial security has increased employer use of identification badges. Badges provide the employer's security personnel with a quick device to identify employees and to intercept and properly direct non-employees on the employer's premises. Similarly, in professional settings, such as at professional conferences, visual wearable identification badges enhance participant interaction, and provide a mechanism for event organizers to quickly identify event participants from other members of the public.

As the need for identification badges has grown so have the ways of wearing them. For example, a plastic sleeve that is mountable, such as by magnets, pins or clips, to a shirt or blouse of the wearer can hold the badge and secure it to the user. While such mountable sleeves generally effectively hold the badge on the user's shirt, they are generally awkward. When mounted to the pocket of a shirt, they tend to pull the shirt and pocket out and down. Also, repeated use of pins to mount the badge to the user's clothing can damage the clothing.

Lanyards have improved the wearability of identification badges. A lanyard is a cord that can be worn around the badge wearer's neck, and to which an identification badge can be attached. Although lanyards have improved the wearability of identification badges, they have not worked well with traditional mechanism for securing the badges. When connected to the lanyard, many of these traditional securing mechanisms twist the badge so that it does not rest flat on the wearer's shirt or blouse. Other such mechanisms do not secure the badge well enough, and, as a result, the badge can pull free from the lanyard too easily and be lost. Some securement mechanisms are too large with respect to the badge and lanyard for a pleasing appearance.

SUMMARY OF THE INVENTION

Therefore, a need exists for an improved lanyard connector and method for connecting the badge to the lanyard that will improve the wearability and securement of identification badges to lanyards, while at the same time providing a pleasing appearance.

In accordance with one aspect of the invention, a system for connecting a lanyard, a buckle, and a fitting is provided. The system comprises a one-piece upper connector having an upper portion for receiving the lanyard and lower portion for receiving a transverse element of an upper portion of the buckle. The system also comprises a lower connector having an upper portion for receiving a transverse element of a lower portion of the buckle. The lower connector also has a lower portion for receiving an upper portion of the fitting.

When the lanyard is received by the upper portion of the upper connector, the upper connector does not cause the buckle to rotate.

In accordance with another aspect of the invention, a quick-connection system for interconnecting a lanyard, a buckle having a lower surface, and a fitting is provided. The system comprises an upper connector for connecting the lanyard to the buckle; and a lower connector for connecting the buckle to the fitting. The longitudinal dimension of the upper connector is less than the longitudinal dimension of the buckle, and the longitudinal dimension of the lower connector is less than the longitudinal dimension of the buckle.

In another aspect of the invention, a connector for connecting a lanyard to a buckle is provided that comprises a first end and a second end positioned outside of and below the first end. The connector also comprises a lower section configured to receive a portion of a buckle and an upper section configured to receive a lanyard. The first end and the second end are positioned near each other to form a gap therebetween. The gap is smaller than the portion of the buckle, and the first and second ends are moveable with respect to one another so as to increase the gap size to equal or exceed the thickness of the portion of the buckle.

In accordance with another aspect of the invention, a connector for connecting a fitting to a buckle is provided that comprises a first end, and a second end positioned outside of and below the first end. The connector also comprises an upper section configured to receive a portion of the buckle, a lower section configured to receive the fitting, and a tab extending from the upper section abuts the buckle, preventing rotation in at least one direction.

In accordance with yet another aspect of the invention, a method for assembling a lanyard-buckle-badge assembly is provided comprising the step of inserting a badge into a lower portion of a fitting, the fitting having an upper portion. The method also comprises quick-connecting the upper portion of the fitting into a lower connector through a gap formed in the lower connector. Then a lower transverse element of a buckle is quick-connected to the lower connector through the lower connector gap. Then an upper transverse element of the buckle is quick-connected to an upper connector through an upper connector gap.

DETAILED DESCRIPTION OF THE PREFERRED EMBODIMENT

Figure 1:
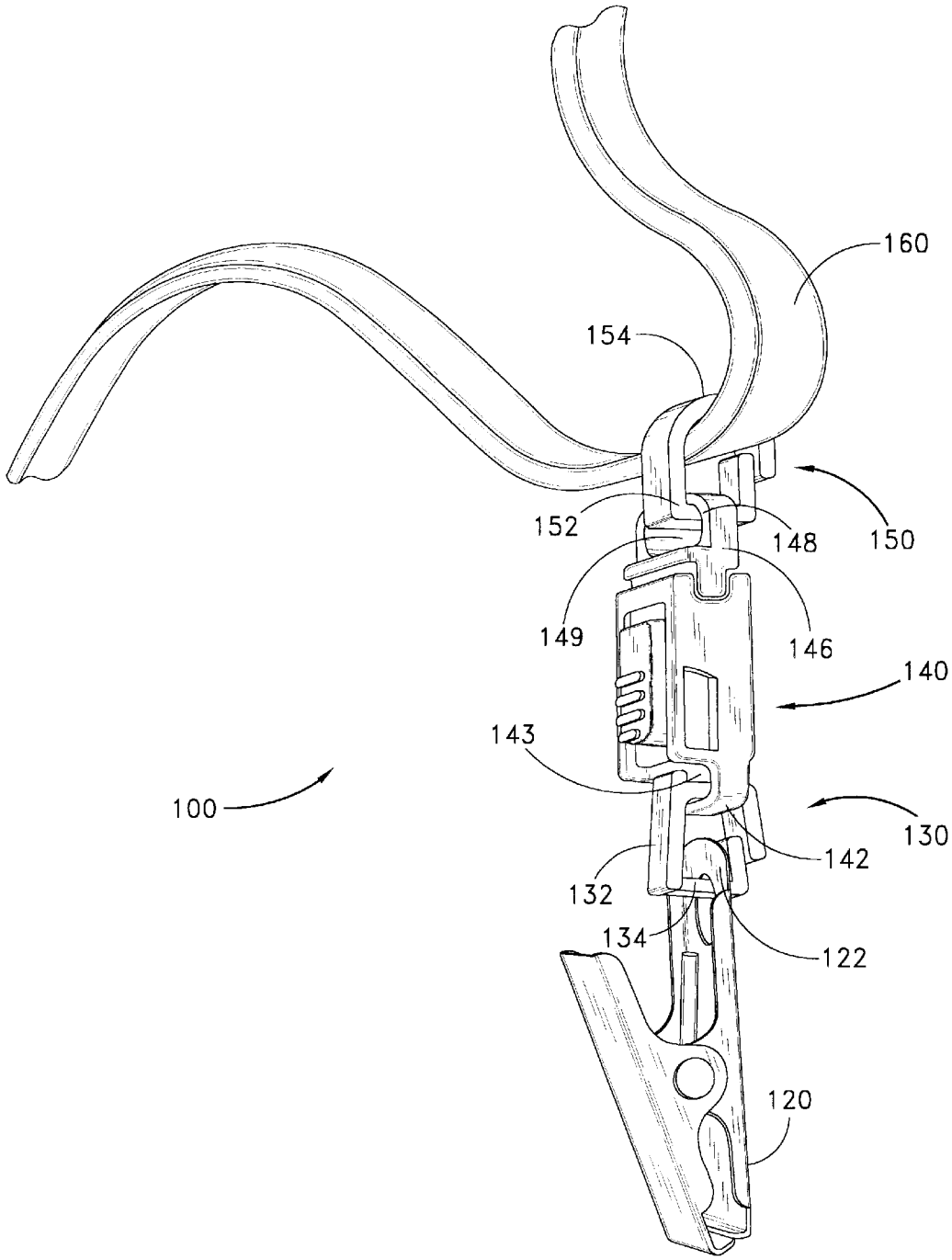
FIG. 1 is a front, perspective, schematic view of one embodiment of a lanyard-buckle-badge assembly.
Figure 1A:
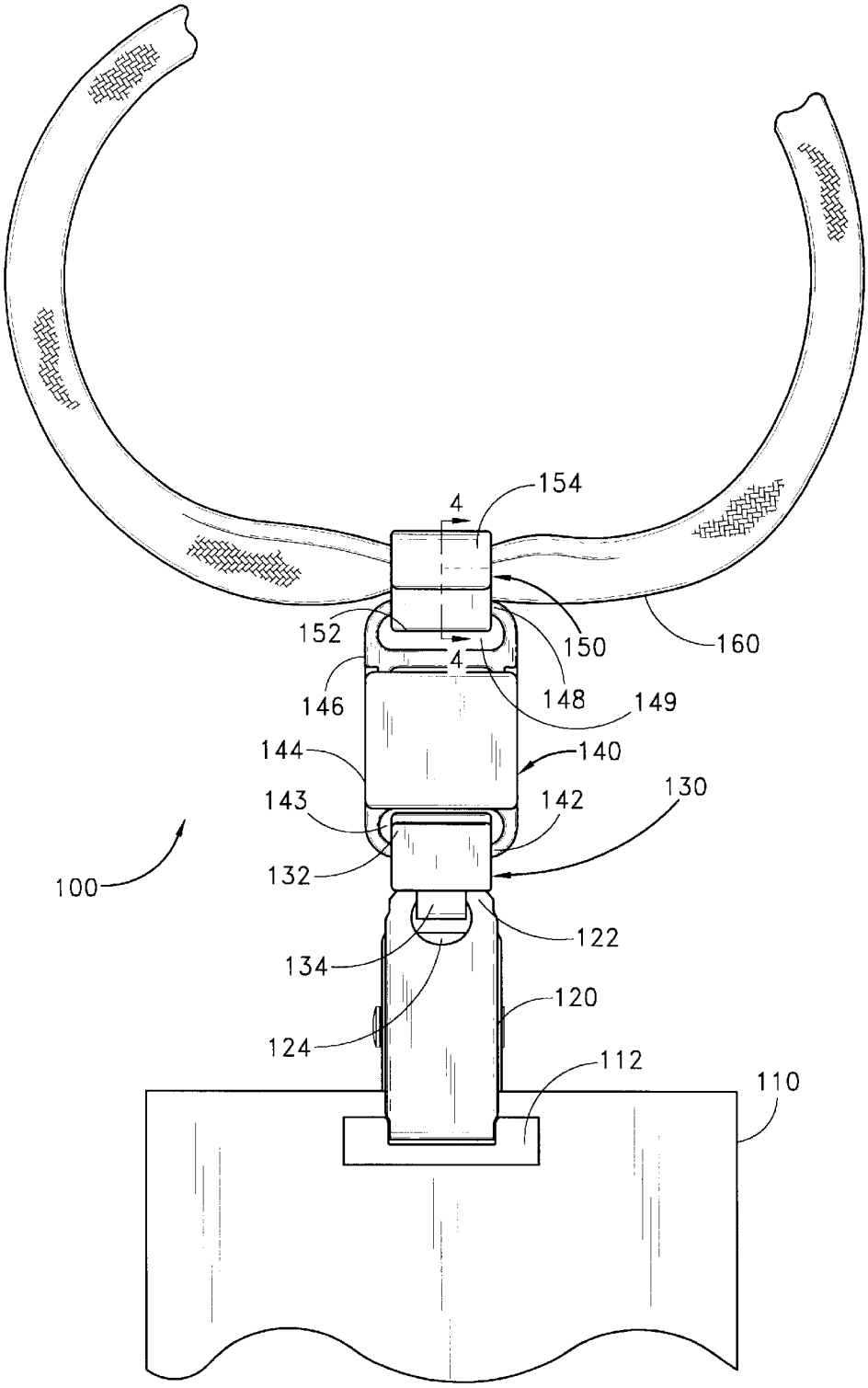
FIG. 1A is a schematic view of the back side of the assembly of FIG. 1.

FIGS. 1 and 1A are schematic views of one embodiment of a lanyard-buckle-badge assembly 100. The assembly 100 comprises an identification badge 110, a fitting 120, a lower connector 130, a buckle 140, an upper connector 150, and a lanyard 160. The identification badge 110 is preferably made of a durable material so that the lanyard-buckle-badge assembly 100 can be used for several days, months, or years.

The badge, of course, can take many forms, but generally contains some useful information that is useful at least in part because it is visual. In general, the badge can be replaced by one of many different articles which could be advantageously dangled from the neck of a wearer, e.g. a whistle, a key, a pen, or other article.

The badge 110 is clasped by a fitting 120 so that the badge 110 seen in FIG. 1A, remains securely attached to the wearer and is not lost. As shown, the fitting 120 can extend through a hole 112 in the badge 110, or it can be secured with a similar fitting such as a hook or key ring.

The fitting 120 is connected to a buckle 140 using a lower connector 130. The buckle 140 can be similar to one manufactured by YKK Corporation. Preferably, the buckle is a quick disconnect buckle that allows a lower portion 144 of the buckle 140 to be detached from and reattached to an upper portion 146 of the buckle 140. For security badges that are designed to be scanned by a machine, the quick disconnect feature is particularly useful; it allows the wearer to detach the badge from the lanyard for such scanning. The buckle 140 has a transverse element 142, which is rectangular in cross-section. The element 142 forms a lower loop 143 that is about twice as wide as it is tall. The buckle 140 also has a transverse element 148, which creates an upper loop 149. Like the lower loop 143, the upper loop 149 is about twice as wide as it is tall. Other types of buckles may also be used with the connectors, connection system, and connection method described herein.

The lower connector 130, as shown in FIGS. 1 and 1A, and as discussed below in more detail in connection with FIG. 3, comprises an upper portion 132 for receiving the transverse element 142 of the lower portion 144 of the buckle 140. Advantageously, the upper portion 132 is U-shaped in order to capture the element 142. The connector 130, as discussed in more detail below, is preferably made of several segments that have planar surfaces.

The connector 130 provides a pleasing appearance and a compact size. In one embodiment, the height of the lower connector is approximately seven-sixteenths of an inch, the depth of the connector (that is, from front to back, as viewed in FIGS. 1 and 1A) is approximately one-quarter of an inch, and the width of the upper portion 132 connector is approximately three-eighths of an inch. Thus, the connector is almost as wide as it is tall. Of course, other size connectors could be used as well to achieve a similarly appealing appearance in accordance with the connectors described herein. The thickness of the upper portion 132 of the lower connector 130 is about one-half the height of the buckle loop 143. In one embodiment, the thickness is about one-sixteenth of an inch. The width of the upper portion 132 is smaller than the width of the loop 143 so that there is a loose fit in the transverse direction between the connector 130 and the buckle 140. For example, the width of the upper portion 132 can be made about one-sixteenth of an inch less than the width of the loop 143.

The lower connector 130 also comprises a lower portion 134 configured to receive an upper portion 122 of the fitting 120. In one embodiment, the width of the lower portion 134 is less than the width of the upper portion 132. For example, the width of the lower portion could be about three-sixteenths of an inch. The width of the lower portion 134 is preferably configured to be slightly less than the width of a loop 124 formed by the upper portion 122 of the fitting 120. The fitting 120 is thus securely held by the lower portion 134 of the connector 130 so that the fitting is not disconnected from the assembly 100, which might cause the fitting and badge 110 to be lost.

As discussed above, the buckle 140 also has an upper portion 146 comprising the transverse element 148 which is secured by the upper connector 150. The transverse element 148 could be a bar, a flexible member under tension, or any other suitable load bearing element. The transverse element 148 preferably is rectangular in cross-section, as is discussed below in connection with FIG. 4.

The connector 150 provides a pleasing appearance, and a compact size. In one embodiment, the height of the upper connector is about the same as the width. In a specific example of a production product, the height is approximately three-eighths of an inch, and the width of the connector is approximately three-eighths of an inch. Thus, the front elevation appearance of the connector is about square. The thickness of the lower portion 152 of the upper connector 150 is about one-half the height of the loop 149. In one embodiment, the thickness is about one-sixteenth of an inch. The width of the lower portion 152 is smaller than the width of the loop 149 so that there is a loose fit in the transverse direction between the connector 130 and the buckle 140. For example, the width of the lower portion 152 can be made about one-sixteenth of an inch less than the width of the loop 149. The depth of the upper portion 154 of the upper connector 150 is approximately five-sixteenths of an inch, and the depth of the lower portion 152 of the upper connector 150 (that is, the front to back dimension as viewed in FIGS. 1 and 1A) is approximately one-quarter of an inch. Thus, the depth is at least half that of the height or the width. Of course, other size connectors could be used as well to achieve a similarly pleasing appearance.

As will be discussed in more detail in connection with FIG. 2, the upper connector 150 comprises a lower section 152 configured to receive the element 148 and an upper section 154 configured to receive a portion of the lanyard 160. Thus, the components below the connector 150 can be securely attached to the lanyard 160 and will not be lost. Advantageously, the lower portion 152 is U-shaped in order to capture the element 148. The connector 150, as discussed in more detail below, is preferably made of several elements that have planar surfaces.

The lanyard 160 is an elongate flexible member that is configured to encircle the neck of a wearer and to be long enough for the badge 110 to hang down to an appropriate level. The length of the lanyard 160 can vary with the size of the wearer, with the size of the badge 110, and with the application. For example, where the buckle 140 is a quick disconnect buckle, and where various items are to be attached to the fitting 120, the length of the lanyard 160 may be shorter or longer than for applications where only a badge 110 is to be connected to the lanyard. The lanyard could also be made adjustable length, as is known in the art. The lanyard 160 can be made of a woven line of varying thickness, a chain, a cord, a strap, or any other suitable elongate line that can properly position the badge 110.

Figure 2:
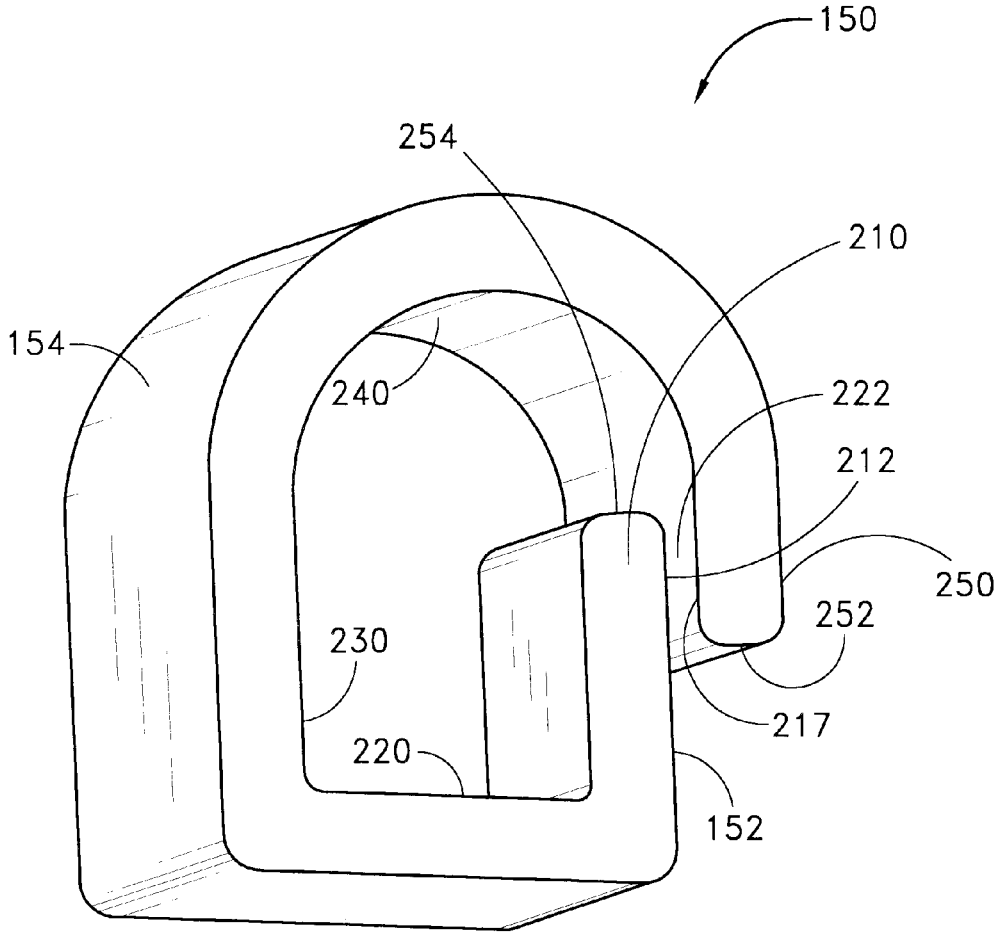
FIG. 2 is an isometric view of an upper connector of FIG. 1.

As shown in FIG. 2, the upper connector 150 has a rear, lower segment 210, a bottom segment 220, a front segment 230, a top segment 240, and a rear, upper segment 250. A gap surface 212 is located on the outer side of the rear lower segment 210 and a gap surface 217 is located on the inner side of the rear upper segment 250. As seen in the isometric view, the five segments 210, 220, 230, 240, and 250 form a substantially closed loop, or ring with the rear, upper segment 250 overlapping and being positioned outside of the rear, lower segment 210. The segments 210, 220, 230, 240, and 250 define a space for receiving the lanyard 160 and a portion of the buckle 140, as discussed above.

When the lanyard-buckle-badge assembly 100 is assembled, the overlapping portion of the upper connector 150 is positioned on the back of the assembly 100. A gap 222 is preferably created between the segment 210 and the segment 250. The gap 222 dimension is preferably about one-sixteenth of an inch wide. Stated more generally, the gap can be made to be less than about one-half of the thickness of the lanyard 160, and less than about one-half of the thickness of the element 148. The gap 222 also can be eliminated entirely so that the gap surface 212 and the gap surface 217 touch each other.

As seen in FIG. 2, the lower-most end 252 of the rear upper segment 250 also is preferably positioned at or below the upper-most end 254 of the rear lower segment 210. Thus, when viewed from the back (see FIG. 1A), the end 254 cannot be seen because it is behind the segment 250, disposed at an elevation above the end 252. Although it is preferred that the end 254 be disposed at an elevation above the end 252, the end 254 could be disposed at an elevation that is less than one-half the thickness of the lanyard 160 or one-half the thickness of the element 148 below the end 252.

The connector 150 also comprises a lower section 152 comprising the segments 210, 220, and 230 configured to receive a portion of the buckle 140 such as the transverse element 148. In one embodiment, at least the segment 220 is a generally flat, planar segment that fits nicely into the buckle loop 149. In the arrangement illustrated, the segments 210 and 230 are also generally planar surfaces. In another embodiment, rather than having three segments, the lower section 152 could comprise two surfaces forming a "V" shape. Also, the lower section 152 could be a curved surface, such as a semicircle.

Figure 4:
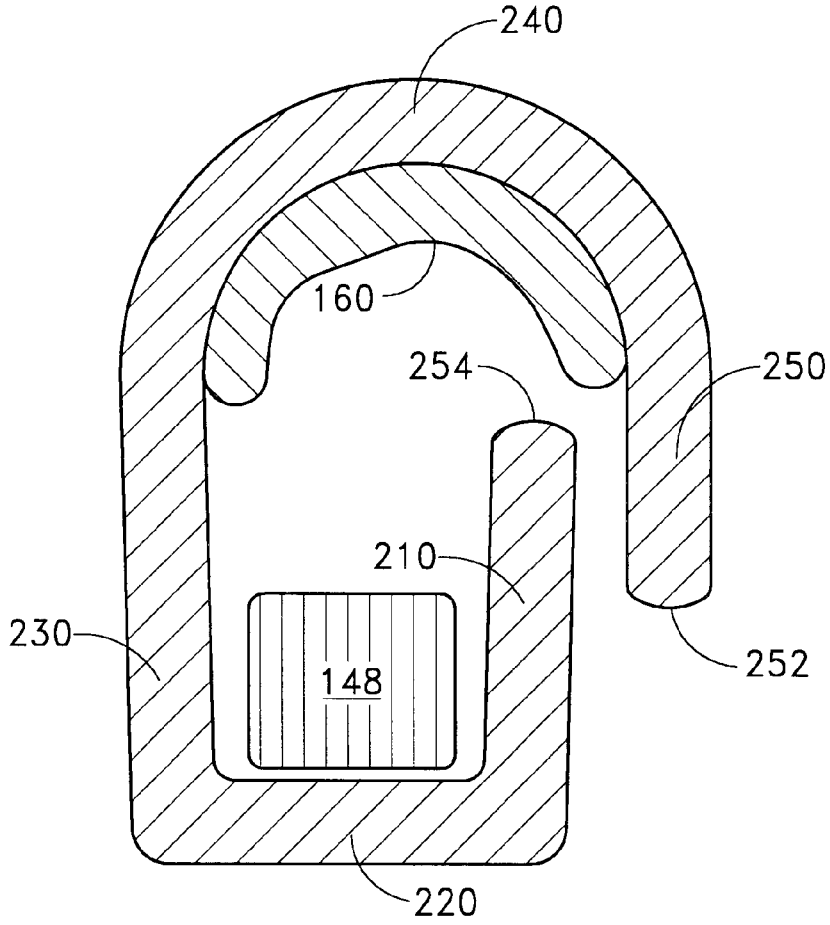
FIG. 4 is a cross-section of the lanyard-buckle-badge assembly 100 of FIG. 1, taken along the plane 4—4.

The connector 150 further comprises an upper section 154 that comprises the segments 230, 240, and 250 that is configured to receive a portion of the lanyard 160. In one preferred embodiment of the upper section 154, the segment 240 is formed as a semicircular internal curve dimensioned so that its internal perimeter is about equal to the width of the flat lanyard 160, shown in FIG. 1, and as seen in FIG. 4. Of course, the shape of the segment 240 need not be semicircular. It could more generally be any curve, or even comprise one or more planar surfaces. As seen, the portions of the segments 34 and 252 that are below the curved upper segment 240 are generally flat.

The connector 150 is manufactured of injection molded plastic, metal, or any other suitable material could be employed. The material should be durable enough to be used continuously for several days, months or years to connect the lanyard 160 to the buckle 140. In addition, the material used to make the connector 150 should be relatively rigid but flexible enough to allow rapid assembly. This material flexibility will allow the ends 252, 254 to be deflected away from one another when either the transverse element 148 or the lanyard 160 is placed in the gap 222. This deflection causes the dimension of the gap 222, which is measured from the gap surface 212 to the gap surface 217, to increase in size. The increased size of the gap 222 allows the transverse element 148 to slide between the surfaces 212, 217. The increased size of the gap 222 also allows the lanyard 160 to slide between the surfaces 212, 217.

Figure 3:
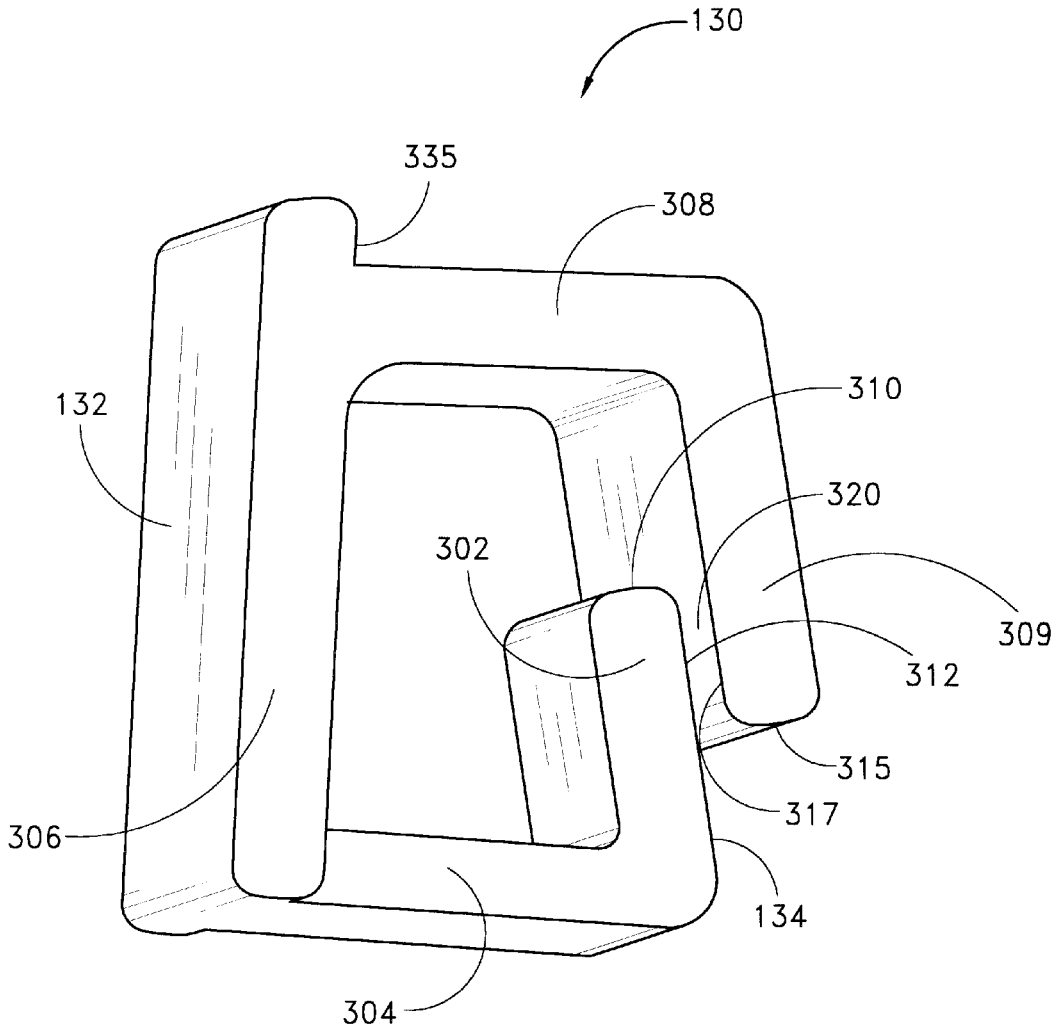
FIG. 3 is an isometric view of a lower connector of FIG. 1.

As seen in FIG. 3, the lower connector 130 comprises a rear lower segment 302, a lower segment 304, a front segment 306, a top segment 308, and a rear, upper segment 309. The segment 302 includes a free end 310 and a gap surface 312 adjacent the end 310. The segment 309 includes a free end 315 and a gap surface 317 adjacent the end 315. As seen in FIG. 3, the segments 302–309 preferably form a closed loop, or ring with the end 315 preferably positioned outside of and at an elevation below the end 310. A gap 320 is formed between the surface 312 and the surface 317 that is preferably about one-sixteenth of an inch. The gap, more generally, can be made less than about one-half of the thickness of the element 142. The gap 320 also can be eliminated entirely so that the gap surface 312 and the gap surface 317 touch each other.

As seen in FIG. 3, the lower-most end 315 of the segment 309 also is preferably positioned at an elevation below the upper-most end 310. Thus, when viewed from the back (see FIG. 1), the end 310 cannot be seen because it is behind the segment 309, disposed at an elevation above the end 315. Although it is preferred that the end 310 be disposed at an elevation above the end 315, the end 310 could be disposed at an elevation that is less than one-half the thickness of the element 142 below the end 315.

The connector 130 also comprises an upper section 132 that includes the upper portions of the segments 306 and 309 and upper segment 308, configured to receive a portion of the buckle 140, such as the transverse element 142 (see FIGS. 1 and 1A). In one embodiment, the segment 308 is a generally flat, planar segment that fits nicely into the buckle loop 143. The segments 306, 308, and 309 are shown as three planar surfaces, but the upper section 132 could, in another variation, comprise two surfaces forming a "V" shape, or a curved surface, such as a semicircle.

The connector 130 further comprises a lower section 134 comprising the segments 302, 304, and 306 configured to receive the fitting 120. The lower segment 304 and the lower portions of the segments 302 and 306 preferably together form a short U-shaped channel in which the upper portion 122 of the fitting 120 is retained. Of course, the profile formed by the segments 302–306 can vary. It could more generally be any profile that retains the upper portion 122 of the fitting 120.

The connector 130 is manufactured of injection molded plastic, but metal, or any other suitable material can be employed. The material should be durable enough to be used continuously for several days, months, or years for connecting the fitting 120 to the buckle 140. In addition, the material used to make the connector 130 should be relatively rigid but flexible enough to allow rapid assembly. In a production version of the connectors 130 and 150, the plastic utilized is referred to as polyoxymethylene. This flexibility will allow the ends 310, 315 to be deflected away from one another when either the transverse element 142 or the fitting 120 is placed in the gap 320. This deflection causes the dimension of the gap 320, which is measured from the gap surface 312 to the gap surface 317, to increase, which allows the transverse element 142 to slide between the surfaces 312, 317. The increased size of the gap 320 also allows the fitting 120 to slide between the surfaces 312, 317.

In one embodiment, the connector 130 preferably also comprises a tab 335 which extends from the upper section 132 as part of the front segment 306. The tab can extend all or part of the way across the top of the upper section 132. The tab 335 mates with a lower surface of the buckle 140 to prevent rotation of the buckle about the upper section 132 toward the front of the connector 130. Such rotation could possibly result in the buckle or fitting becoming wedged in the connector or disconnected from the connector 130. Thus the tab 335 advantageously prevents that occurrence, and also helps keep the badge in proper orientation.

The configuration of connectors 130, 150 permits a process for assembling a lanyard-buckle-badge assembly 100 that is simple and efficient. In the assembly method the badge 110 is inserted into a lower portion of a fitting 120. Next the upper portion of the fitting 120 is inserted into a lower connector 130 through the gap 320 formed between the gap surfaces 312, 317 of the lower connector 130. As described above, the gap 320 may be less than the thickness of the fitting 120. However, as described above, the connector 130 is made of a material that is flexible enough to allow the ends 310, 315 to flex which causes the gap 320 to become larger. Thus, the fitting can slide through the gap and become securely positioned within the connector 130.

Next, the lower transverse element 142 of the buckle 140 is inserted into the lower connector 130 through the lower connector gap 320. Again, the insertion of the buckle 140 may rely upon the flexibility of the connector 130. The upper transverse element 148 of the buckle 140 then is inserted into the upper connector 150 through the gap 222 formed between the gap surfaces 212, 217 of the upper connector 150. Then the lanyard 160 is inserted into the upper connector through the upper connector gap 222. As described above, and in connection with connector 130, the connector 150 is made of a material that is flexible enough to allow the ends 252, 254 to flex which causes the gap 222 to become larger. Thus, the element 148 and the lanyard 160 can slide through the gap 222 and become securely positioned within the connector 150.

The above description is given by way of example and not limitation. Given this disclosure, one skilled in the art could devise variations that are within the scope and spirit of the invention. Further, the various features of this invention can be used alone or in varying combinations with each other, and are not intended to be limited to the specific combination described herein. Thus, the invention is not to be limited by the illustrated embodiment, but is to be defined by the following claims, when read in the broadest manner to preserve the validity of the claims.

What is claimed is:

1. A lanyard assembly comprising:

a lanyard configured to be worn about a person's neck;

a quick disconnect buckle having an upper portion with an upper loop, and a lower portion with a lower loop;

a one-piece upper connector having a substantially closed ring-shaped configuration with overlapping free ends that can be flexibly separated to receive said lanyard into an upper portion of the connector and to receive into its lower portion a transverse element forming an upper wall of said buckle loop;

a fitting to carry an article; and a one-piece lower connector having a substantially ring-shaped configuration with overlapping free ends which can be flexibly separated to receive a transverse element forming a wall of said loop on the lower portion of said buckle, and to receive an upper portion of the fitting into a lower portion of the lower connector.

2. The assembly of claim 1, wherein said lower connector has a front segment with a tab on its upper end which is configured to prevent the buckle from rotating downwardly around the lower connector.

3. A system for connecting a lanyard, a buckle, and a fitting, the system comprising:

a one-piece upper connector having a substantially loop-shaped configuration with free ends positioned close to each other, said connector being formed of relatively rigid material but being sufficiently flexible such that the free ends can be separated to permit a portion of a lanyard into an upper portion of the connector and to receive a transverse element of an upper portion of the buckle into a lower portion of the connector; and a one-piece lower connector having a generally loop-shaped configuration with free ends positioned adjacent each other, said lower connector being made of relatively rigid material but being relatively flexible such that said free ends of the lower connector can be flexibly separated to permit a transverse element of a lower portion of the buckle to be received in an upper portion of the lower connector, and to receive an upper portion of the fitting into a lower portion of the lower connector.

4. The system of claim 3, wherein said upper connector free ends are overlapping, and said lower connector free ends are overlapping.

5. The system of claim 3, wherein said upper connector has a generally flat lower segment which fits within a loop formed on the upper end of the buckle; and wherein said lower connector has a generally flat upper segment to fit into a loop formed on the lower end of the buckle.

6. The system of claim 5, wherein said upper connector has a front segment having a lower generally flat end joined to one end of said upper connector lower segment and an upper end that joins with a curved upper segment, said upper connector further having a rear upper segment having its upper end joined to said curved upper segment and having its lower end being one of said upper connector free ends, said upper connector further having a lower rear segment spaced from said front segment and having a lower end connected to an end of said lower segment, said rear lower segment having an upper end forming the other of said upper connector free ends.

7. The system of claim 5, wherein said lower connector has a generally flat front segment joined to a forward end of said upper segment and having a lower end secured to one end of a lower segment, said lower connector further having a rear lower segment spaced from said front segment, having a lower end joined to said lower segment, and having an upper end forming one of said lower connector free ends, said lower connector further having an upper rear segment having an upper end joined to said upper segment and having a lower end forming the other of said lower connector free ends.

8. The system of claim 3, wherein said lower connector has a generally flat front segment joined to a forward end or said upper segment and having a lower end secured to one end of a lower segment, said lower connector further having a rear lower segment spaced from said front segment, having a lower end joined to said lower segment, and having an upper end forming one of said lower connector free ends, said lower connector further having an upper rear segment having an upper end joined to said upper segment and having a lower end forming the other of said lower connector free ends.

9. A connector for connecting a fitting to a buckle comprising:

a one-piece body forming a loop, said body including:

a lower segment, a front segment having a lower end joined to one end of the lower segment, an upper segment joined to an upper end of said front segment, a rear upper segment having an upper end joined to said upper segment and having a free lower end, a rear lower segment having a lower end joined to a second end of said lower segment and having an upper free end, said ends being closely positioned to each other, said body being made of relatively rigid material but being sufficiently flexible such that said free ends may be flexibly separated to receive a transverse element of the lower end of a buckle into an upper portion of said loop, and to receive an upper portion of a fitting, and a tab on said upper portion that prevents the buckle from rotating forwardly around the element captured in the loop.

10. The connector of claim 9, wherein the free end on the rear upper segment extends below and is outside of the free end on the rear lower segment.

11. The connector of claim 9, wherein said tab is an extension of the upper end of said front segment.

* * * * *